US010208444B2

(12) United States Patent
Mast et al.

(10) Patent No.: US 10,208,444 B2
(45) Date of Patent: Feb. 19, 2019

(54) SNOW DIRECTING AND DISCHARGING ASSEMBLY

(71) Applicant: Briggs & Stratton Corporation, Wauwatosa, WI (US)

(72) Inventors: James W. Mast, Sheboygan Falls, WI (US); Peter C. Jerger, Cedarburg, WI (US); Jorge A. Colmenero, Milwaukee, WI (US); James J. Dimsey, Elm Grove, WI (US); Samuel J. Gerritts, Pewaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 15/583,923

(22) Filed: May 1, 2017

(65) Prior Publication Data

US 2017/0233963 A1 Aug. 17, 2017

Related U.S. Application Data

(63) Continuation of application No. 13/944,639, filed on Jul. 17, 2013, now Pat. No. 9,663,909.

(60) Provisional application No. 61/751,307, filed on Jan. 11, 2013, provisional application No. 61/698,230, filed on Sep. 7, 2012.

(51) Int. Cl.
*E01H 5/09* (2006.01)

(52) U.S. Cl.
CPC ..... *E01H 5/098* (2013.01); *E01H 5/094* (2013.01)

(58) Field of Classification Search
CPC .. E01H 5/04; E01H 5/076; E01H 5/09; E01H 5/098; F16D 27/112; F16D 45/00; F16D 2027/002; F16B 2/02; F16B 2/065; F16B 2/14; F16B 2/24
USPC ..... 37/249, 257, 248; 15/22.3, 78, 80
See application file for complete search history.

(56) References Cited

U.S. PATENT DOCUMENTS 1,569,531 A * 1/1926 Barry ..... E01H 5/098 37/250
1,629,321 A 5/1927 Simpson
1,701,767 A * 2/1929 Barry ..... E01H 5/098 37/251
2,171,075 A * 8/1939 Blazier ..... E01H 5/04 15/79.2
2,397,305 A * 3/1946 Wheat ..... B65G 33/00 100/145
2,610,414 A 9/1952 Vanvick
2,712,211 A * 7/1955 Smith ..... A01D 34/005 15/4
2,921,329 A * 1/1960 Peterson ..... A46B 13/04 15/182

(Continued)

FOREIGN PATENT DOCUMENTS

GB 1336306 11/1973
JP 03066810 A * 3/1991 ..... E01H 5/04

(Continued)

*Primary Examiner* — Thomas B Will
*Assistant Examiner* — Joan D Misa
(74) *Attorney, Agent, or Firm* — Rathe Lindenbaum LLP

(57) ABSTRACT

A snow thrower may include an auger housing; and an auger flight assembly. The auger flight assembly may include a drive shaft rotatable about an axis and helical blades and helical pliable flights, wherein the helical blades and the helical pliable flights alternate with one another along an axial length of the drive shaft.

9 Claims, 12 Drawing Sheets

(56) References Cited

U.S. PATENT DOCUMENTS 2,941,223 A * 6/1960 Klauer ..... A46B 13/001 15/79.2
3,086,789 A * 4/1963 Kleiman ..... E01H 1/056 15/79.2
3,150,455 A 9/1964 Indorf
3,241,172 A * 3/1966 Tilgner ..... A46B 13/005 15/182
3,278,966 A 10/1966 Godfrey
3,314,095 A 4/1967 Prange
3,603,008 A 9/1971 Heth
3,649,984 A 3/1972 Kershaw et al.
3,673,715 A * 7/1972 Lines ..... E01H 5/098 37/195
3,735,510 A 5/1973 Godfrey et al.
3,766,586 A 10/1973 Krickovich
3,805,421 A 4/1974 Kamlukin et al.
3,886,675 A 6/1975 Maisonneuve et al.
3,913,247 A 10/1975 Ruhl
4,203,237 A 5/1980 Enters et al.
4,322,896 A 4/1982 Miyazawa
4,408,922 A 10/1983 D'Alessio
4,477,989 A 10/1984 Vachon
4,490,877 A * 1/1985 Drumm ..... A46B 3/14 15/179
4,563,867 A 1/1986 Bokon
4,602,400 A 7/1986 Agergard et al.
4,651,452 A 3/1987 Husso
4,694,594 A 9/1987 Thorud et al.
4,760,657 A 8/1988 Ganzmann et al.
4,908,968 A 3/1990 Thorud et al.
4,951,403 A 8/1990 Olmr
5,123,186 A 6/1992 Matushita et al.
5,133,139 A 7/1992 Rzechula
5,174,053 A 12/1992 Takeshita
5,209,003 A 5/1993 Maxfield et al.
5,410,825 A * 5/1995 Perrelli ..... E01H 5/062 37/232
5,445,438 A * 8/1995 Drumm ..... A46B 13/005 15/183
5,540,004 A 7/1996 Patterson et al.
5,784,756 A 7/1998 Slocum et al.
6,260,293 B1 7/2001 Monroe
6,327,798 B1 12/2001 Sakai
6,470,602 B2 10/2002 White, III
6,860,041 B2 3/2005 Sakai et al.
6,865,826 B1 3/2005 Lakin
7,121,021 B2 10/2006 Sakai
7,257,909 B2 8/2007 Shaffer et al.
D554,155 S 10/2007 Yuzuriha
7,305,777 B2 12/2007 Kettering
7,730,642 B2 6/2010 Sugiura
8,474,086 B1 7/2013 Smith
8,844,172 B2 * 9/2014 Cmich ..... E01H 5/045 37/248
2002/0020083 A1 2/2002 White, III et al.
2002/0108274 A1 * 8/2002 Dowe ..... E01H 5/04 37/257
2010/0193322 A1 8/2010 Saiia
2011/0314707 A1 12/2011 Raftery
2014/0150302 A1 6/2014 Mast et al.

FOREIGN PATENT DOCUMENTS

JP 04981017 6/2012
WO WO2010061472 6/2010

* cited by examiner

SNOW DIRECTING AND DISCHARGING ASSEMBLY

CROSS-REFERENCE TO RELATED PATENT APPLICATIONS

The present application is a continuation application claiming priority under 35 USC 120 from co-pending U.S. patent application Ser. No. 13/944,639 filed on Jul. 17, 2013 by Mast et al. and entitled SNOW DIRECTING AND DISCHARGING ASSEMBLY, which claims priority under 35 USC 119(e) from U.S. Provisional Patent Application Ser. No. 61/698,230 filed on Sep. 7, 2012 by Gerrits et al. and entitled TWO STAGE SNOW THROWER WITH SURFACE CLEARING IMPLEMENT, and which also claims priority under 35 USC 119(e) from U.S. Provisional Patent Application Ser. No. 61/751,307 filed on Jan. 11, 2013 by James W. Mast et al. and entitled TWO STAGE SNOW THROWER WITH SURFACE CLEARING IMPLEMENT, the full disclosures of which are each hereby incorporated by reference.

BACKGROUND

The use of snow throwers (or snowblowers) is common by both commercial and residential operators located in snowy winter climates. These snow throwers may be walk-behind units or may be propelled by other machinery (e.g., all-terrain vehicles, tractors, etc.). Typically, snow throwers are divided into two categories: single-stage snow throwers and two-stage snow throwers. Single-stage snow throwers generally incorporate an impeller assembly that is driven by an internal combustion engine (or similar prime mover) to perform the functions of propelling the snow thrower forward, lifting snow from the surface to be cleared, and ejecting the snow out of a discharge chute. Alternatively, a two-stage snow thrower comprises a separate auger assembly and impeller assembly. Both the auger assembly and impeller assembly are driven by an internal combustion engine (or similar prime mover). The auger assembly rotates near the surface to be cleared in order to lift and direct snow and debris to the impeller assembly, which rotates along an axis perpendicular to the axis of rotation of the auger assembly. The impeller assembly then acts to eject snow out of a discharge chute.

In single-stage snow throwers, the impeller assembly is generally formed of a flexible material which contacts the surface to be cleared as it is directed along a path by the user. Due to this direct contact with the surface, single-stage snow throwers typically clear the entire surface of snow quite well. However, because the impeller assembly performs the tasks of propelling the snow thrower, lifting the snow, and ejecting the snow from the discharge chute, there are limitations to the size, shape, and material of the impeller assembly. These limitations reduce the effectiveness of the impeller assembly of a single-stage snow thrower in deep and/or heavy snow conditions.

On the other hand, two-stage snow throwers are generally more adept at clearing deep and/or heavy snow than their single-stage counterparts. This is because the auger assembly of two-stage snow throwers is typically formed of a rigid material (e.g., metal) that both separates and lifts the snow to be cleared and delivers it to the impeller assembly for ejection from the discharge chute. However, as the auger assembly is formed as a rigid, non-continuous component, the auger assembly is generally positioned within an auger housing so as to be a certain distance above the surface to be cleared. While in some ways it is advantageous for the rigid auger assembly to not contact the surface to be cleared, there is also the potential disadvantage of some snow being left behind and/or compacted as the snow thrower passes.

Accordingly, it would be advantageous to have a snow thrower capable of handling deep and/or heavy snow conditions yet actively and effectively cleaning snow directly from the surface to be cleared.

DETAILED DESCRIPTION OF THE EXAMPLE EMBODIMENTS

Figure 1:
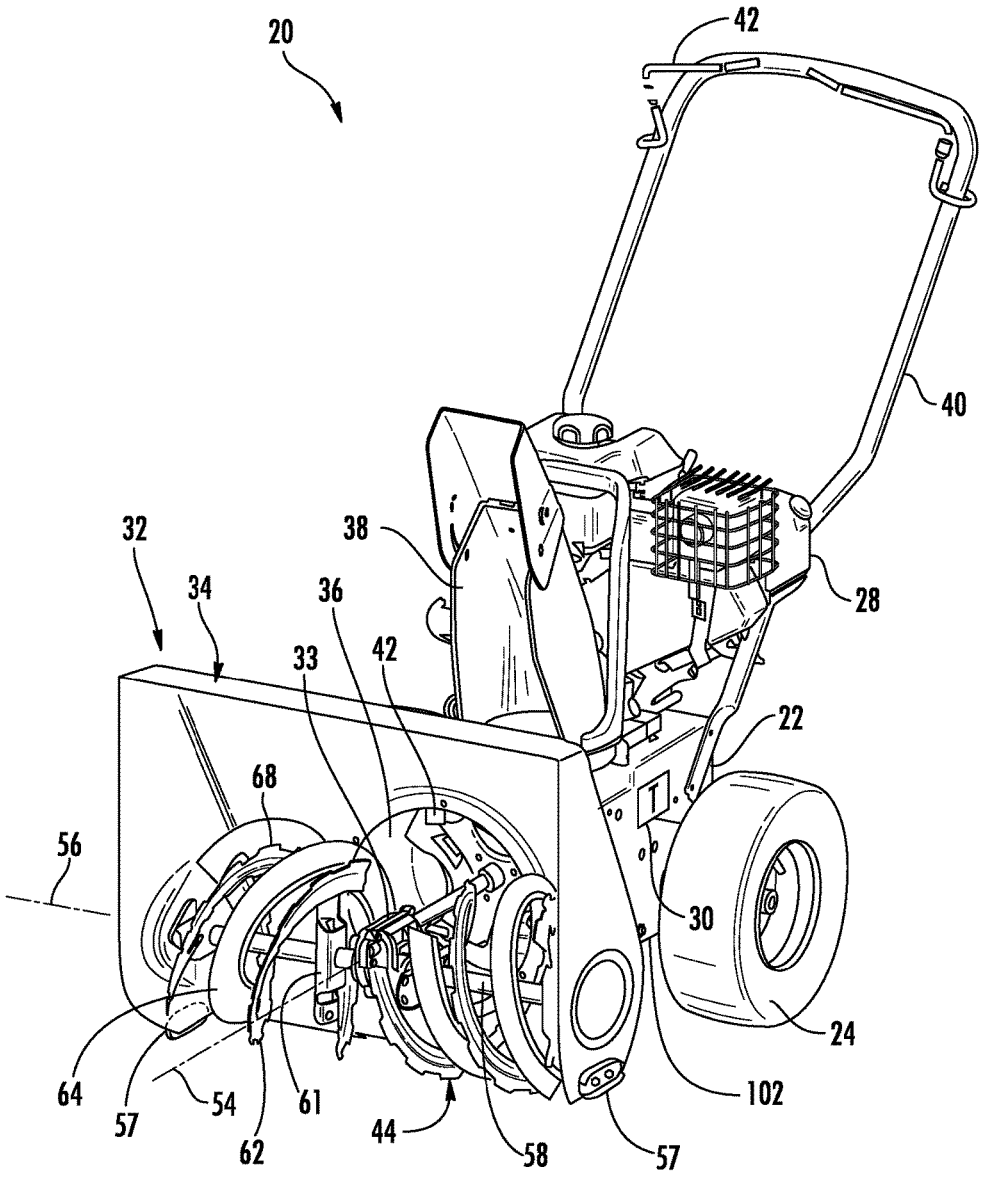
FIG. 1 is a front perspective view of an example snow thrower.
Figure 2:
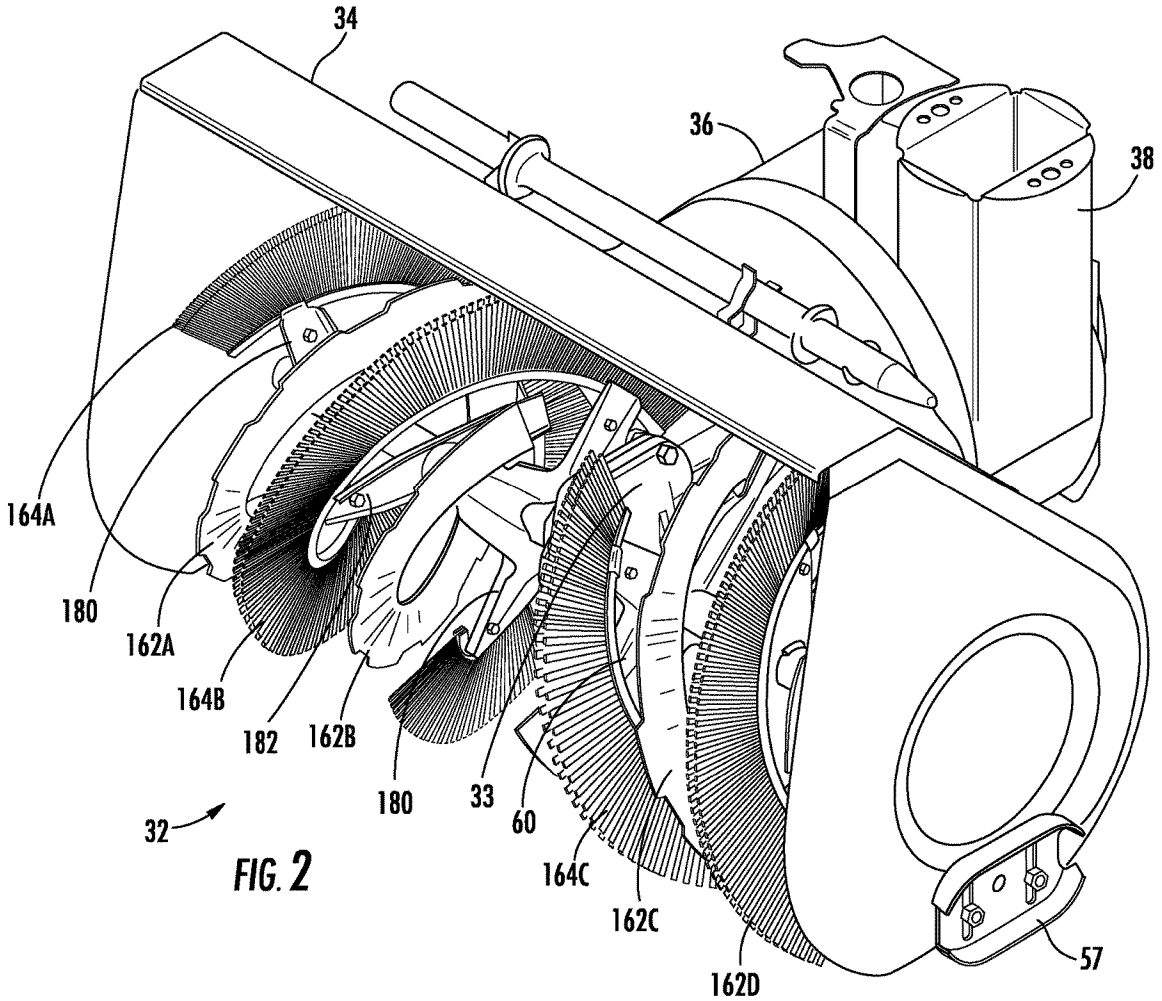
FIG. 2 is a front perspective view of an example snow directing and discharging assembly of the snow thrower of FIG. 1.
Figure 3:
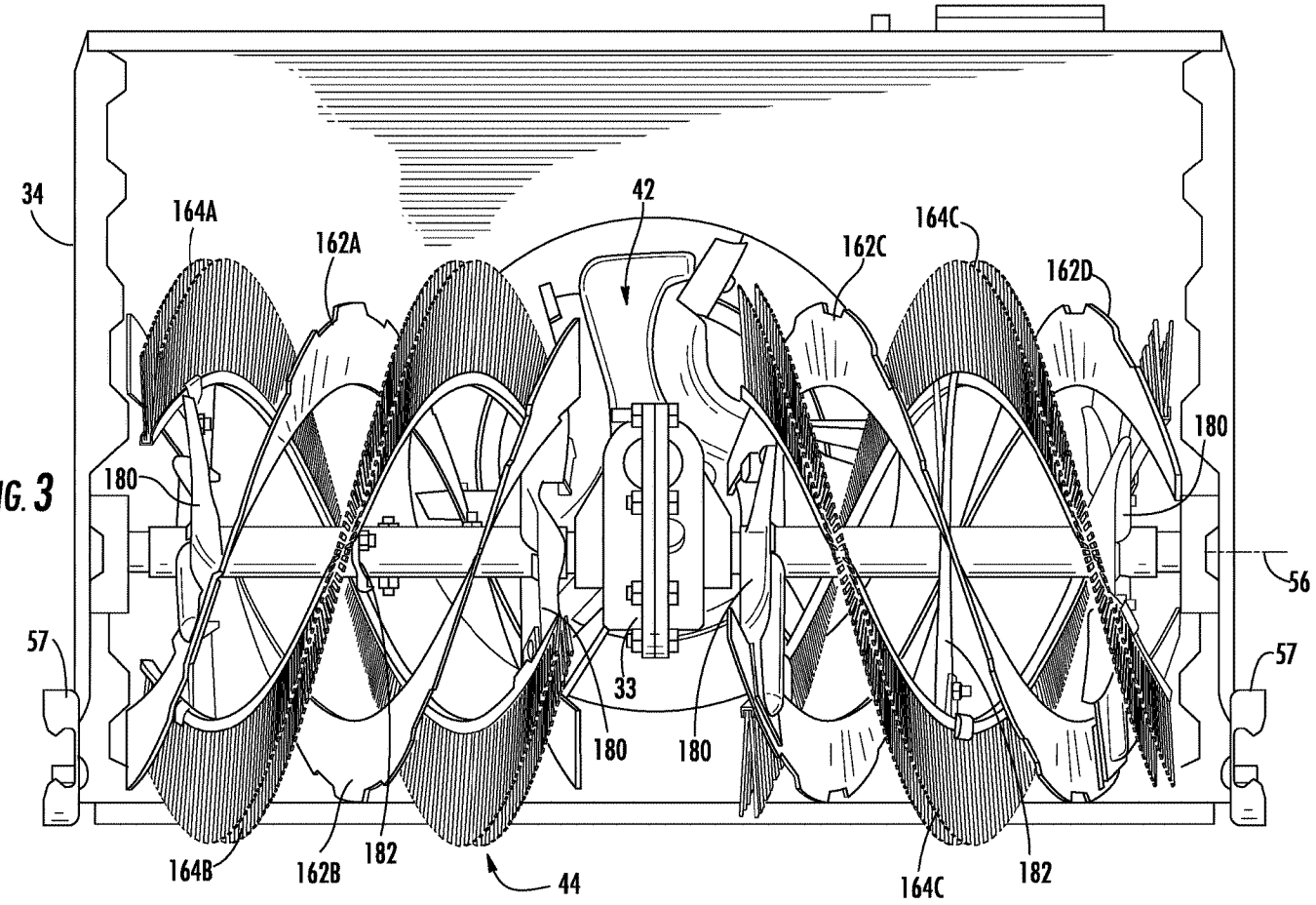
FIG. 3 is a front view of the snow directing and discharging assembly of FIG. 1.

FIG. 1 is a front perspective view of a snow thrower 20 according to an example embodiment. As will be described hereafter, snow thrower 20 has snow directing and discharging assembly that facilitates simplified and inexpensive manufacture with enhanced snow handling capabilities. Snow thrower 20 includes frame 22, axle 24, wheels 24, engine 28, drive transmission 30 (schematically shown), and a snow directing and discharging assembly 32 which comprises snow discharge transmission 33, auger housing 34, impeller housing 36, discharge chute 38, impeller 42 and auger flight assembly 44.

Frame 22 comprises one or more structures supporting the remaining components of snow thrower 20. In the example illustrated in which snow thrower 20 is a walk-behind snow thrower, frame 22 supports wheels 24, engine 28, drive transmission 30 (schematically shown), and snow directing and discharging assembly 32. Frame 22 further supports handles or grips 40 and controls 42. In other embodiments where snow thrower 20 comprises a riding snow thrower, frame 22 may additionally support a seat and may be supported by a greater number of wheels, inner rings or other ground propulsion members. In embodiments where snow thrower 20 is mounted to another vehicle, such as a lawnmower, all-terrain vehicle, truck or the like, frame 22 may or may not support axle 24 and wheels 24 and may be configured to be removably mounted to the vehicle. In embodiments where snow thrower 20 is powered by the engine or other torque source of the vehicle to which snow thrower 20 is mounted, frame 22 may not support an engine, such as engine 28, and may alternatively merely comprise a mounting structure or bracket supporting snow directing and discharging assembly 32 and facilitating their connection to the vehicle. Frame 22 may have a variety of different sizes, shapes and configurations depending upon the machine or method by which snow thrower 20 is moved across the terrain.

Wheels 24 are joined to an axle (not shown) so as to elevate and support frame 22 above the terrain 52. Wheels 24 further facilitate movement of snow thrower 20 across a terrain. In the example illustrated, wheels 24 are rotationally driven to propel snow thrower 20. In other embodiments, wheels 24 may be physically pushed by a person or other vehicle. In some embodiments, wheels 24 may be replaced with other ground engaging members. In embodiments where snow thrower 20 is supported along the terrain by another vehicle, the axle as well as wheels 24 may be omitted.

Engine 28 comprises an internal combustion engine supported by frame 22 and operably coupled to wheels 24 by drive transmission 30 so as to drive wheels 24. Engine 28 is further operably coupled to snow directing and discharging assembly 32 so as to rotationally drive auger 32 about axis 56 and so as to rotationally drive impeller 34 about axis 54. In other embodiments, engine 28 may alternatively only drive auger 32 and impeller 42. In other embodiments, other mechanisms may be used to drive auger 32, impeller 42 or drive wheels 24.

Transmission 30 (schematically shown) comprises a series or arrangement of structures configured to transmit torque from engine 28 to wheels 24 via the axle. Likewise, snow discharge transmission 33 comprises a series or arrangement of structures configured to transmit torque from engine 28 to impeller 42 and auger flight assembly 44. Examples of such structures include, but are not limited to, drive shafts and driven shafts, chain and sprocket arrangements, belt and pulley arrangements, gear trains and combinations thereof. In one embodiment, transmission 33 is disposed on both sides of impeller 42, wherein transmission 33 extends between engine 28 and impeller 42 and wherein transmission 33 further extends between impeller 42 and auger flight assembly 44. For example, in one embodiment, transmission 33 may include a bevel gear between impeller 42 and auger flight assembly 44 for converting torque about axis 54 from impeller 42 to torque about axis 56 for auger flight assembly 44.

Auger housing 34 forms the head of snow thrower 20 and partially extends about or partially surrounds auger 32. In the example illustrated, auger housing has a lower edge supported and led along the surface to be cleaned upon skid shoes 57, which aid in movement of the snow thrower and help prevent damage to auger housing 34. Auger housing 100 rotationally supports auger 32 for rotation about axis 56 which is perpendicular to axis 54 and the direction of forward travel.

Impeller housing 36, also sometimes referred to as a "can", extends about impeller 42 and opens into an interior of auger housing 34. Impeller housing 36 further opens into chute 38. Impeller housing 36 cooperates with impeller 42 such that snow impelled or moved by impeller 42 is directed up and through chute 104.

Chute 38 comprises one or more structures configured to receive snow impelled by impeller 42 and to direct such snow away from snow thrower 20. In the example illustrated, chute 38 is configured to be selectively rotated about a substantially vertical axis such that snow may be blown or thrown to either transverse side of snow thrower 20 and at various rear and forward angles with respect to snow thrower 20. In one embodiment, chute 38 is configured to be manually rotated about a vertical axis. In other embodiments, such rotation may be powered. In yet other embodiments, chute 38 may be stationary.

Auger flight assembly 44 comprises a mechanism to carry out two functions: (1) to slice or cut through snow and to direct or move such snow towards impeller 34 and (2) to sweep or otherwise remove snow from the underlying terrain. Auger flight assembly 44 comprises hub 58, supports 60, 61, helical auger flight blades 62 and helical pliable flights 64. Hub 58 comprises one or more shafts operably coupled to discharge transmission 33 so as to be rotated about axis 56 under power from engine 28 (or another prime mover). Support 60 extends from hub 58 and supports end portions of blade 62 and flight 64. Supports 61 support intermediate portions of flight 64.

Auger flight blades 62 are supported about hub 58 and helically extend about hub 58 so as to cut through snow and direct snow towards axis 54 and impeller 42. In the example illustrated, each of auger flight blades 62 comprise outer teeth 68 which assist in cutting through hardened snow. In one implementation, auger flight blades 62 are similar to the auger flights illustrated and disclosed in co-pending PCT Patent Application Serial No. PCT/US12/20083 file on Jan. 3, 2012 by Samuel J. Gerritts et al. and entitled TWO-STAGE SNOW THROWER CHUTE, the full disclosure of which is hereby incorporated by reference. In other implementations, auger flight blade 62 may have other configurations.

Helical pliable flights 64 comprise helical panels or helical walls having pliable tips or pliable end portions. For purposes of this disclosure, the term "pliable" with respect to pliable flights 64 or corresponding structures in the disclosure means that at least the end portions of the flight 64 have sufficient rigidity to move into compacted snow to cut through and move (or lift) the compacted snow while having sufficient flexibility so as to resiliently flex or bend as the end portions of the flight 64 are rotated in engagement with terrain underlying the compacted snow. The pliable end portions of helical pliable flights 64 have a rigidity less than the rigidity of auger flight blade 62.

In the example illustrated, helical pliable flights 64 comprise a resiliently flexible panels or belting extending our projecting radially beyond teeth 68 of helical auger flight blades 62. As will be described hereafter, in other implementations, helical pliable flights 64 may comprise a resiliently flexible walls or panels formed from bristles or in the form of a helically extending brush. Because helical pliable flights 64 project radially outward of teeth 68 (radially with respect to axis 56), flights 64 may engage the terrain underlying compacted snow so as to cut through the compacted snow as well as lift substantially on compacted snow that would otherwise not be reached are engaged by blade 68, allowing more of the snow upon the underlying terrain to be removed or cleaned away. At the same time, because flights 64 are pliable, flights 64 are less likely to inflict damage to the underlying terrain, such as a pavement, driveway, sidewalk or the like. Because flights 64 are helical, flights 64 additionally assist in moving snow towards impeller 42.

FIGS. 2-7 illustrate snow directing and discharging assembly 132, another example implementation of snow directing and discharging assembly 32. Assembly 132 may be employed as part of snow thrower 20 shown in FIG. 1 in place of assembly 32. Assembly 132 may alternatively be employed and other snow throwers driven by any suitable prime mover (internal combustion engine or electrical motor). Assembly 132 is similar to assembly 32 except that assembly 132 comprises auger flight assembly 144 in lieu of auger flight assembly 44. Those remaining components of assembly 132 which correspond to components of assembly 132 are numbered similarly.

Auger flight assembly 144 comprises hub 58, supports 60, a plurality of auger flight blades 162A, 162B, 162C, 162D (collectively referred to as auger flight blades 162) and a plurality of helical pliable flights 164A, 164B, 164C, 164D (collectively referred to as flights 164). Auger flight blades 162 are similar to auger flight blades 62. Each auger flight blade 162 comprises a thin rigid helical blade formed from metal and having a sufficient rigidity so as to not bend or flex while cutting through compacted or hardened snow. Auger flight blades 162 helically extend about hub 58. Each auger flight blade 152 includes outer edge teeth 68 to better facilitate cutting through snow. As hub 58 rotates about axis 56, auger flight blades 162A, 162B, 162C, 162D also rotate so as to separate and direct snow from the surface to be cleared to impeller 102 for discharge. While four auger flight blades 162A, 162B, 162C, 162D are shown, one of ordinary skill in the art will recognize that more or fewer auger flights may be used dependent upon the length of hub 58 and design of the auger flight assembly 144.

Figure 4:
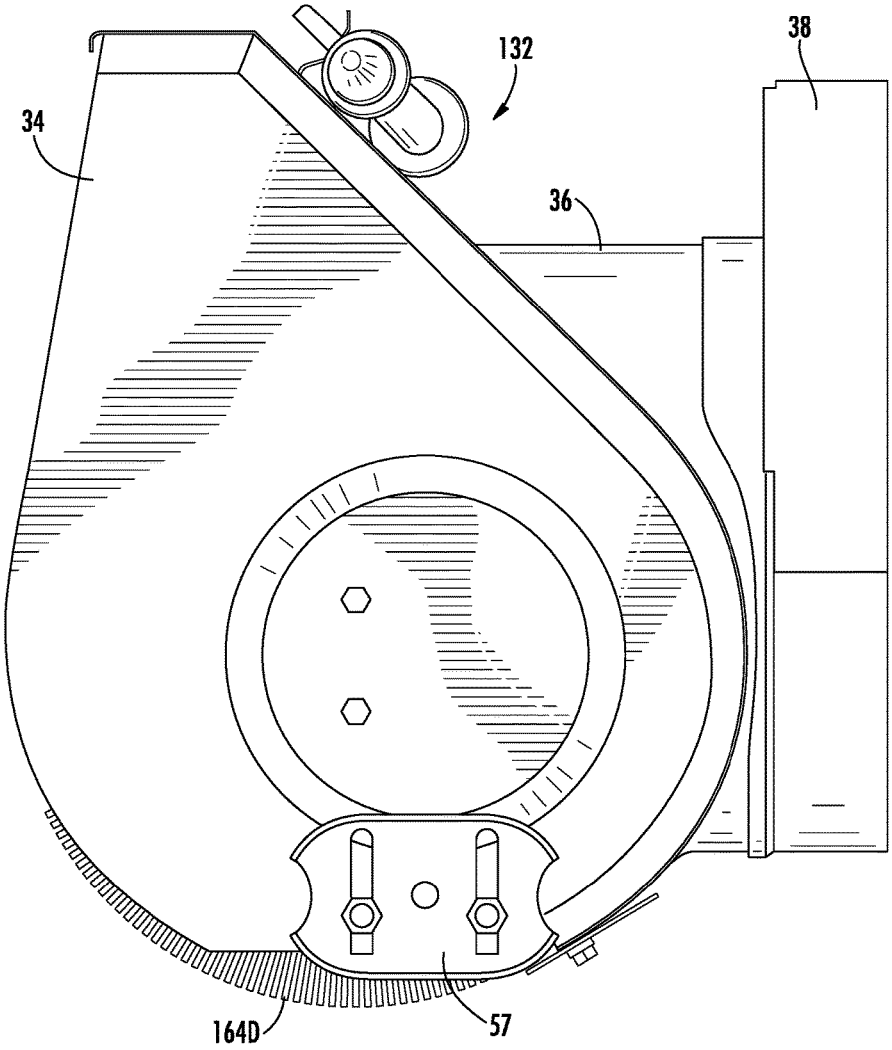
FIG. 4 is a side view of the snow directing and discharging assembly of FIG. 1.
Figure 5:
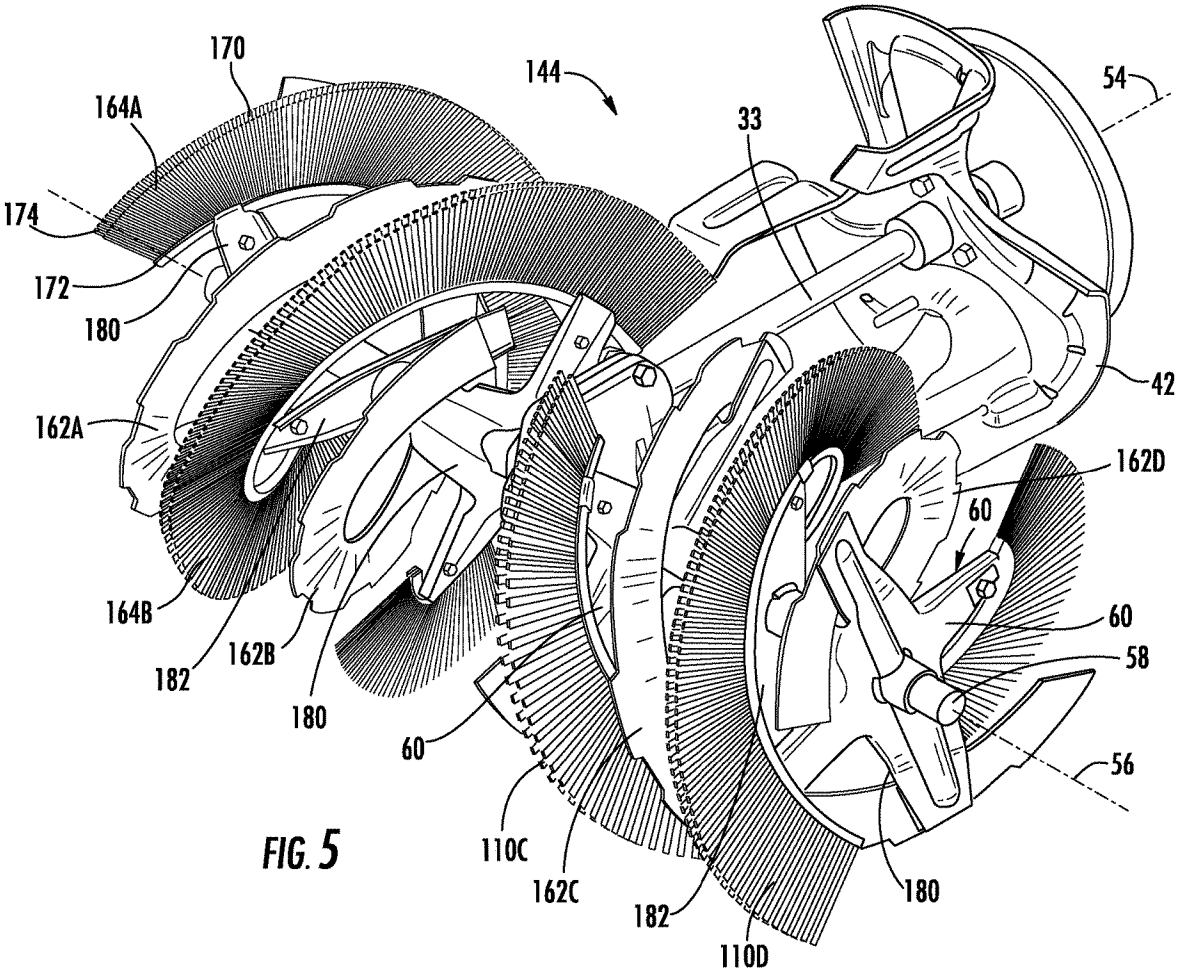
FIG. 5 is a front perspective view of a portion of the snow directing and discharging assembly of FIG. 1 comprising a snow discharge transmission, an impeller and an auger flight assembly.
Figure 6:
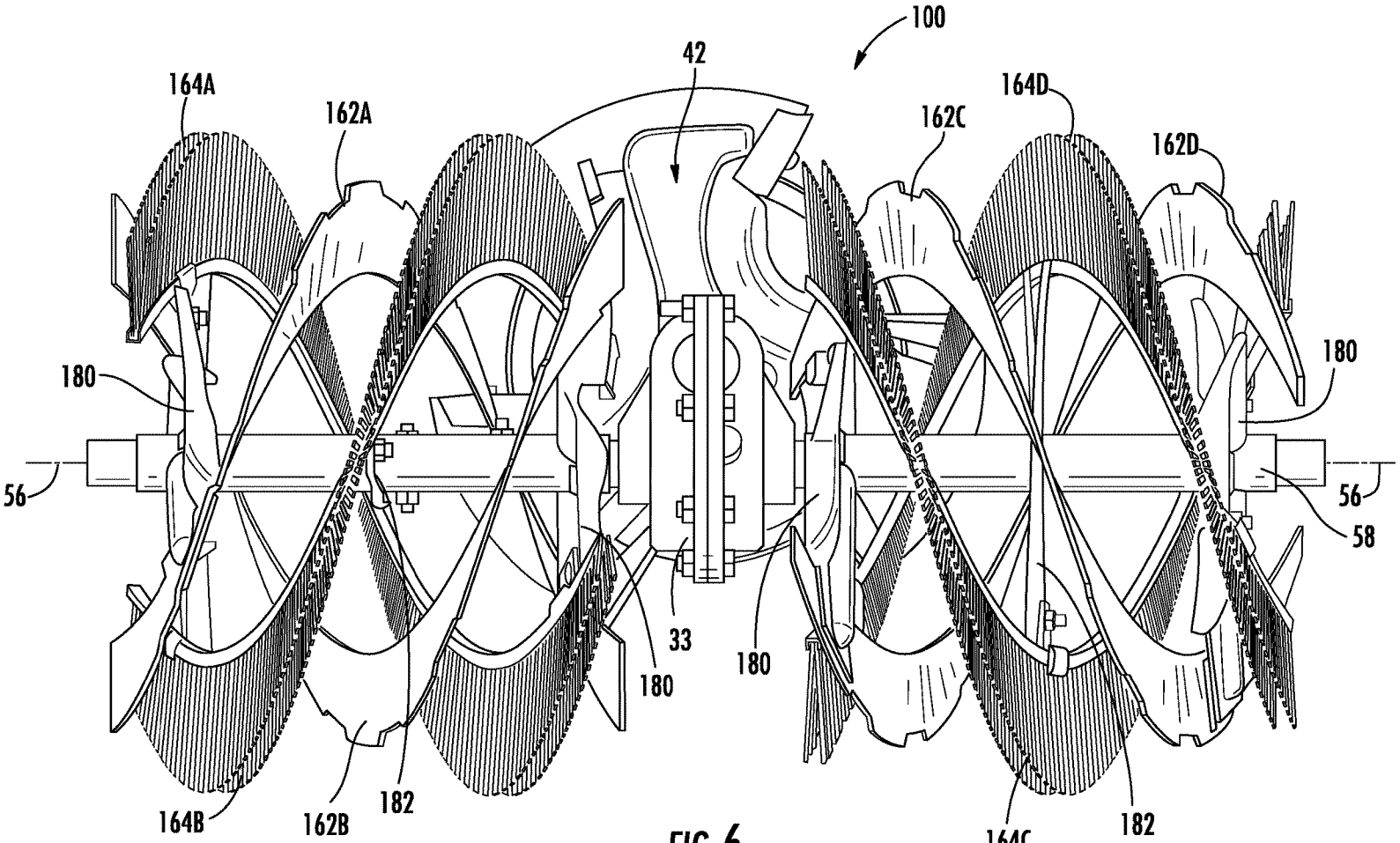
FIG. 6 is a front view of the portion of the snow directing and discharging assembly of FIG. 5.

Helical pliable flights 164A, 164B, 164C, 164D comprise brushes interposed or interleaved between auger flight blades 162. As shown by FIG. 6, helical auger flight blade 162A and the helical auger flight blade 162B spiral 180° out of phase with respect to one another. Helical pliable flight 164B extends between blade 162A and 162B. Helical pliable flight 164A helically extends about the rotational axis 56, wherein the helical pliable flight 164B and the second helical pliable flight 164A spiral 180° out of phase with respect to one another. The helical pliable flight 164B and the first helical auger flight blade 162A spiral in phase with one another while the helical pliable flight 164A and the helical auger flight blade 162B spiral in phase with one another. As shown by FIG. 4, the brushes forming flights 164 also extend radially beyond the outside diameter of auger flight blades 162. In the example illustrated, the brushes forming flights 164 radially extend at least ½ inch and nominally at least 1 inch radially beyond the outermost portions of auger flight blades 162, the edges of teeth 68. The brushes forming flights 164 further extend beyond a lowermost edge of auger housing 34. As a result, the brushes forming flights 164 resiliently flex into depressions, recesses or other surface irregularities below auger housing 34 where snow may compact and collect and where such snow may not be reachable by the lower scraping edge of auger housing 34 or blades 62.

Flights 164 are formed of a substantially resiliently flexible pliable material that is suitable for direct contact with the surface to be cleared. Specifically, in one implementation, flights 164 are made of a multiple individual pliable fingers, extensions or other elongate members 170 held in place by a backing 172, wherein the backing 172 is formed into a spiral. In one implementation, members 170 comprise synthetic bristles held in a backing 172 formed from metal. The synthetic bristle material may be, for example, Nylon-Type 6, Nylon-Type 6.6, Nylon-Type 6.12, Nylon-Conductive, Polypropylene, Polyester, Abrasive Nylon, Steel Wire, Stainless Steel-Type 304 Wire, Stainless Steel-Type 316 Wire, Brass Wire, or Phosphorous Bronze Wire. In other implementations, the pliable members 170 may be formed from other materials and may have other configurations other than bristles. In one implementation, each pliable member 170 may have a varying rigidity along its length. For example, in one implementation, each pliable member 170 may have the first rigid end portion mounted within backing 172, a second rigid end portion forming a wear resistant tip and an intermediate portion between the first and second portions that is pliable, allowing the second rigid end portion to resiliently flex to accommodate irregularities of the underlying terrain being brushed or cleaned.

As further shown by FIGS. 2-6, each helical pliable flight 164 is composed of multiple rows 174 of pliable members 170. In the example illustrated, the rows 174 of pliable members 170 outwardly diverge from one another so as to have a V-shape. As a result, each of flights 164 has an enlarged width along its outer helical edge, enhancing snow removal by flight 164. Although illustrated as having two diverging rows 174, in other implementations, each flight 164 may have greater than two rows 174 or may comprise a single row 174. In some implementations, rows 174 may not diverge, but alternatively extend parallel to one another. In other implementations, in lieu of being arranged in rows, pliable members 170 may alternatively be arranged in other patterns or randomly arranged.

Figures 7, 8:
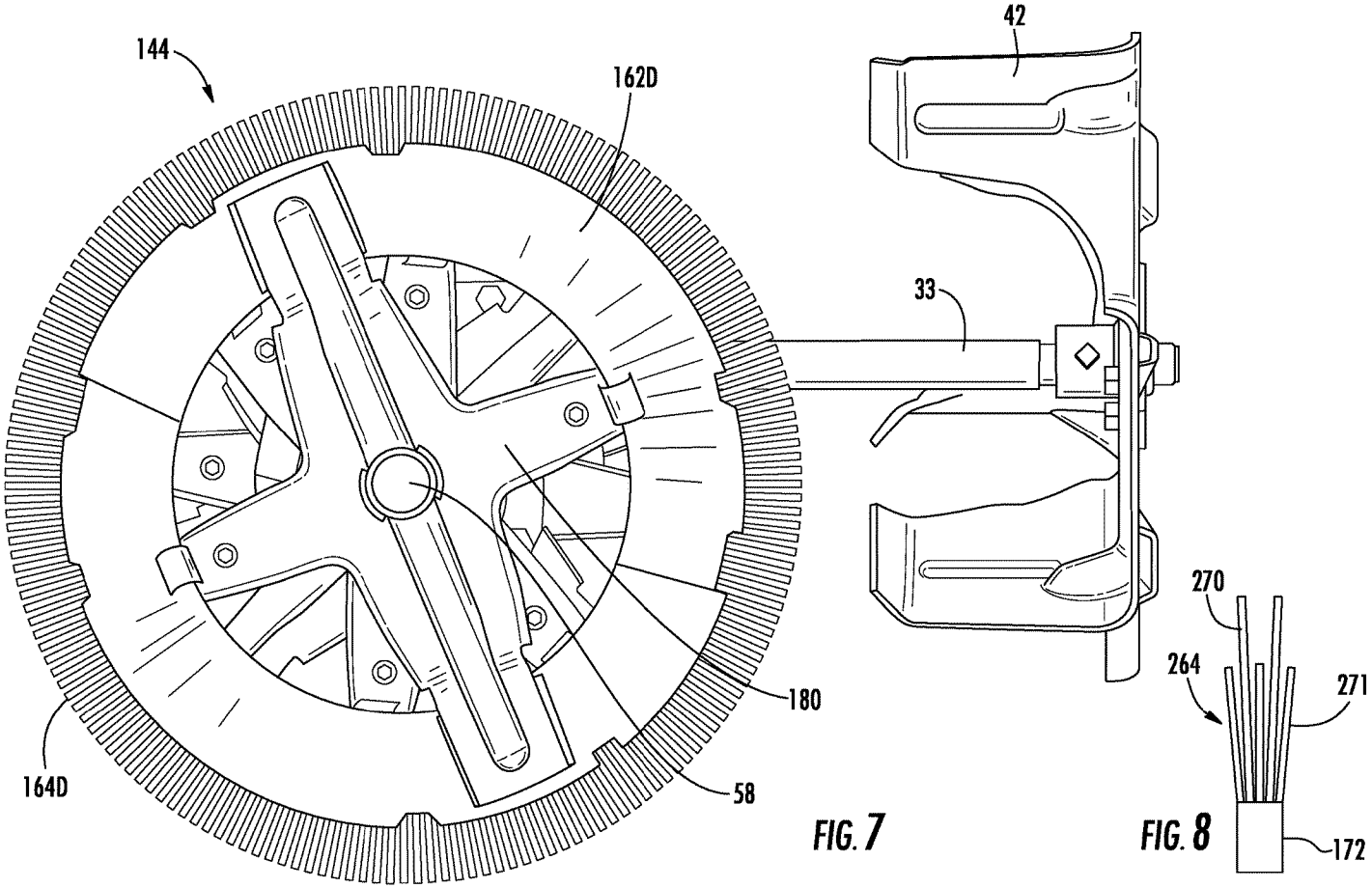
FIG. 7 is a side view of the portion of the snow directing and discharging assembly of FIG. 5.
FIG. 8 is an enlarged view of an example helical pliable flight of the snow directing and discharging assembly of FIG. 2.
Figure 9:
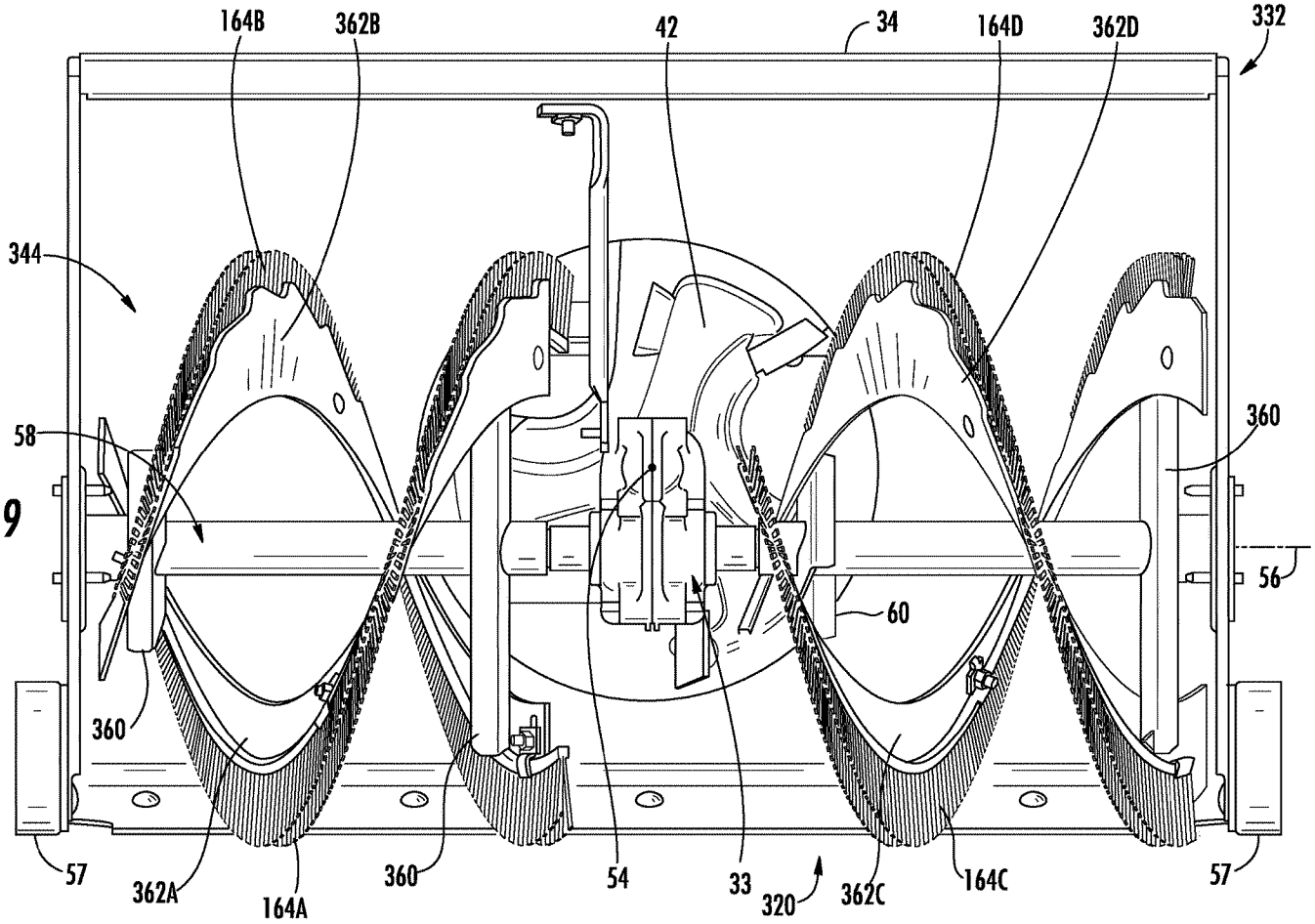
FIG. 9 is a front view of another snow thrower including another example implementation of the snow directing and discharging assembly of FIG. 2.

In other embodiments, a combination of these different pliable members, such as different bristle types, may also be used. FIG. 8 illustrates pliable flight 264, another implementation of an individual pliable flight 164. Pliable flight 264 comprises a combination of longer pliable extensions or members 270 (e.g., synthetic bristles) extending from backing 172 and having a first rigidity with shorter pliable extensions or members 271 (e.g., metallic wire bristles) extending from backing 172 and having a second lesser rigidity interspersed therein. The shorter more rigid pliable members 271 afford a more aggressive removal of compacted snow without actually contacting the surface to be cleaned while the longer more flexible pliable members 270 resiliently flex and project into underlying depressions and surface irregularities which would otherwise be unreachable. Alternatively, the brush flights utilizing synthetic bristles are replaced with one or more metal spiral mounting flights having a rubber flight(s) attached thereto, similar to helical pliable flights 64 described above with respect to FIG. 1. Such rubber flight(s) may be formed of a homogenous strip of rubber belting or a rubber belting with fingers cut into one side of the strip so as to contact the surface to be cleared for effective snow removal.

In addition to illustrating helical pliable flights 164, FIGS. 3, 5, 6 and 7 further illustrate supports 60 in more detail. In the example illustrated, supports 60 comprise combined flight supports 180 and pliable flight supports 182. Combined flight supports 180 each radially extend from hub 58 and are each joined to an end of each of two helical auger flight blades 62 and two helical pliable flights 164. In particular, each combined flight support 180 is attached to the two helical auger flight blades 62 that are rotationally offset 180° from one another and the two helical pliable flights 164 that are rotationally offset 180° from one another and 90° from the adjacent helical auger flight blades 62. In the example illustrated, each combined flight support 180 has a "+" shape. Each pair of obsolete extending legs of combined flight support 180 is twisted in opposite directions about an axis perpendicular to axis 56 so as to extend parallel to the opposing surfaces of helical auger flight blade 162 and helical pliable flights 164 to facilitate better mating and more reliable securement to the inner edge portions or sides of helical auger flight blades 162 and helical pliable flights 164. Because combined flight supports 180 concurrently support each pair of angularly offset helical auger flight blades 162 and each pair of helical pliable flight 164 at one axial location along hub 58, helical auger flight blades 162 and the pliable flights 164 are compactly and reliably supported with fewer components.

Pliable flight supports 182 comprise elongate linear structures extending from hub 58 and connected at opposite ends to distinct adjacent pliable flights 164 that are rotationally offset about axis 56 by 180°. As with combined flight supports 180, the opposite end portions of supports 182 are twisted with respect to one another about an axis perpendicular to axis 56 so as to more closely face or extend parallel to the opposing surfaces of the pair of angularly offset helical pliable flights 164 to facilitate better mating and more reliable securement to the inner edge portions or sides of the helical pliable flights 164. Pliable flight supports 182 are axially located between combined flight supports 180. Pliable flight supports 182 provide additional support and rigidity to the helical pliable flight 164 which may have less rigidity as compared to the helical auger flight blades 62 due to the pliable nature of the brushes forming flights 164. In other implementations, supports 182 may be omitted where each backing 172 provides sufficient strength and rigidity.

FIGS. 9-12 illustrate snow thrower 320, another example implementation of snow thrower 20 shown in described above with respect to FIGS. 1-8. Snow thrower 320 is similar to snow thrower 20 except that snow thrower 320 comprises snow directing and discharging assembly 332 in place of snow directing and discharging assembly 32. Those remaining components of snow thrower 320 are shown in FIG. 1. Snow directing and discharging assembly 332 is similar to snow directing and discharging assembly 32 except that assembly 332 comprises auger flight assembly 344 in lieu of auger flight assembly 44. Those remaining components of auger flight assembly 344 which correspond to components of auger flight assembly 44 are numbered similarly.

Figure 10:
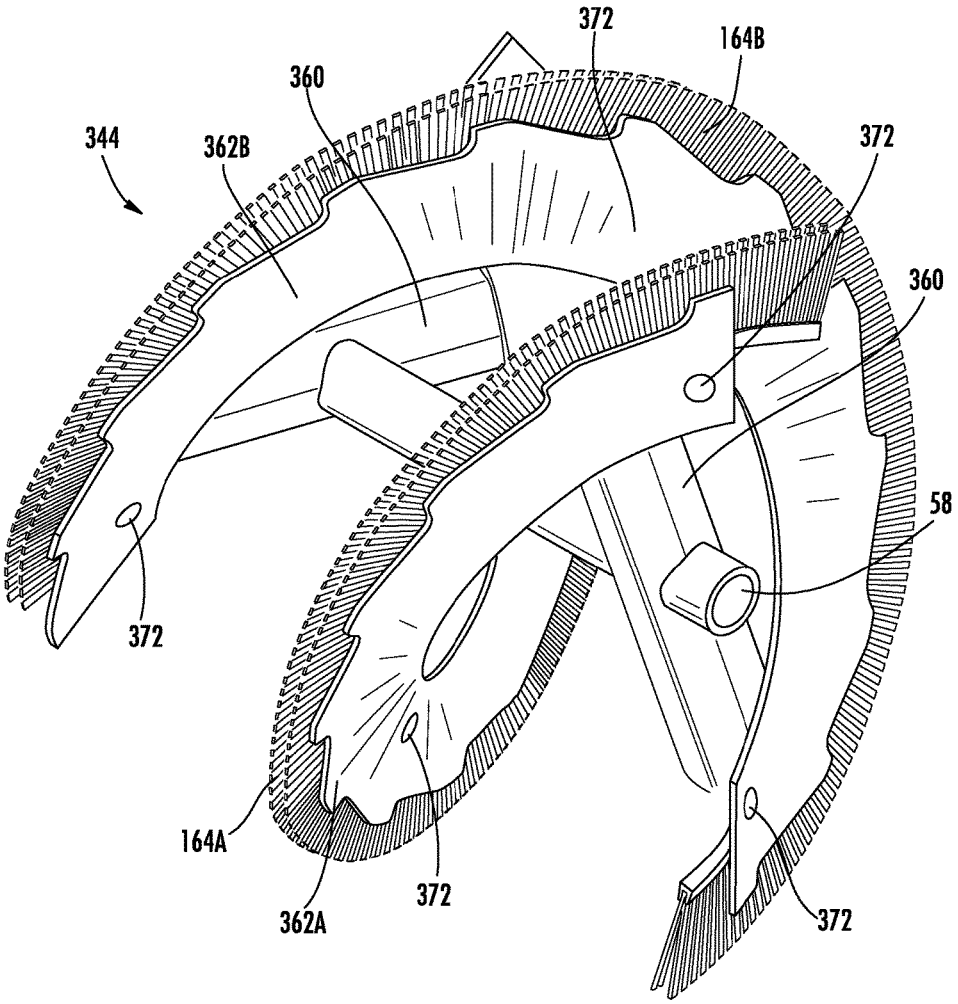
FIG. 10 is a perspective view of a first portion of the auger flight assembly of the snow directing and discharging assembly of FIG. 9.
Figure 11:
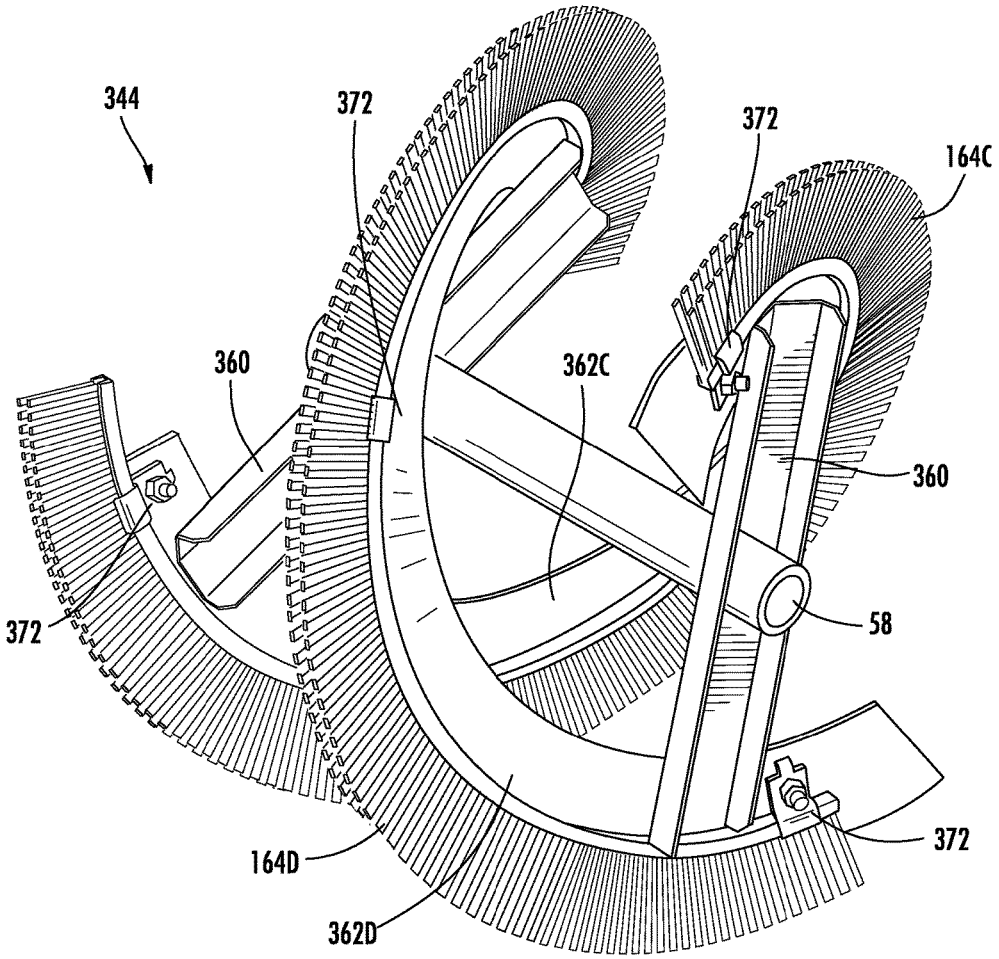
FIG. 11 is another perspective view of a second portion of the auger flight assembly of FIG. 9.

Auger flight assembly 344 comprises hub 58 (described above), supports 360, a plurality of auger flight blades 362A, 362B, 362C, 362D (collectively referred to as auger flight blades 362) and a plurality of helical pliable flights 164A, 164B, 164C, 164D (collectively referred to as flights 164) (described above). As shown by FIGS. 10 and 11, supports 360 comprise bars extending from opposite sides of hub 58, with opposite ends of each of supports 360 attached or coupled to end portions of different auger flight blades 362. In one implementation, supports 360 are fastened to end portions of flight blades 362. In another implementation, supports 360 are welded, bonded or integrally formed as a single unitary body with end portions of flight blades 362. Supports 360 support and space distinct auger flight blades 362 at angularly offset positions about axis 56. In the example illustrated, supports 360 support auger flight 362 at locations angularly offset from one another by 180°, wherein the helix formed by auger flight 362 are angularly offset by one another by 180°. In other implementations, an additional number of auger flights and an additional number of supports may be utilized, wherein the auger flights are offset from one another by other angular extents.

Auger flight blades 362 are similar to auger flight blades 62 described above except that auger flight blades 362 are configured to support helical pliable flights 164. As with auger flight blades 62, auger flight blades 362 are supported about hub 58 and helically extend about hub 58 so as to cut through snow and direct snow towards axis 54 and impeller 42. In the example illustrated, each of auger flight blades 62 comprise outer teeth 68 which assist in cutting through hardened snow. In one implementation, auger flight blades 62 are similar to the auger flights illustrated and disclosed in co-pending PCT Patent Application Serial No. PCT/US12/20083 file on Jan. 3, 2012 by Samuel J. Gerritts et al. and entitled TWO-STAGE SNOW THROWER CHUTE, the full disclosure of which is hereby incorporated by reference. In other implementations, auger flight blade 362 may have other configurations.

Figure 12:
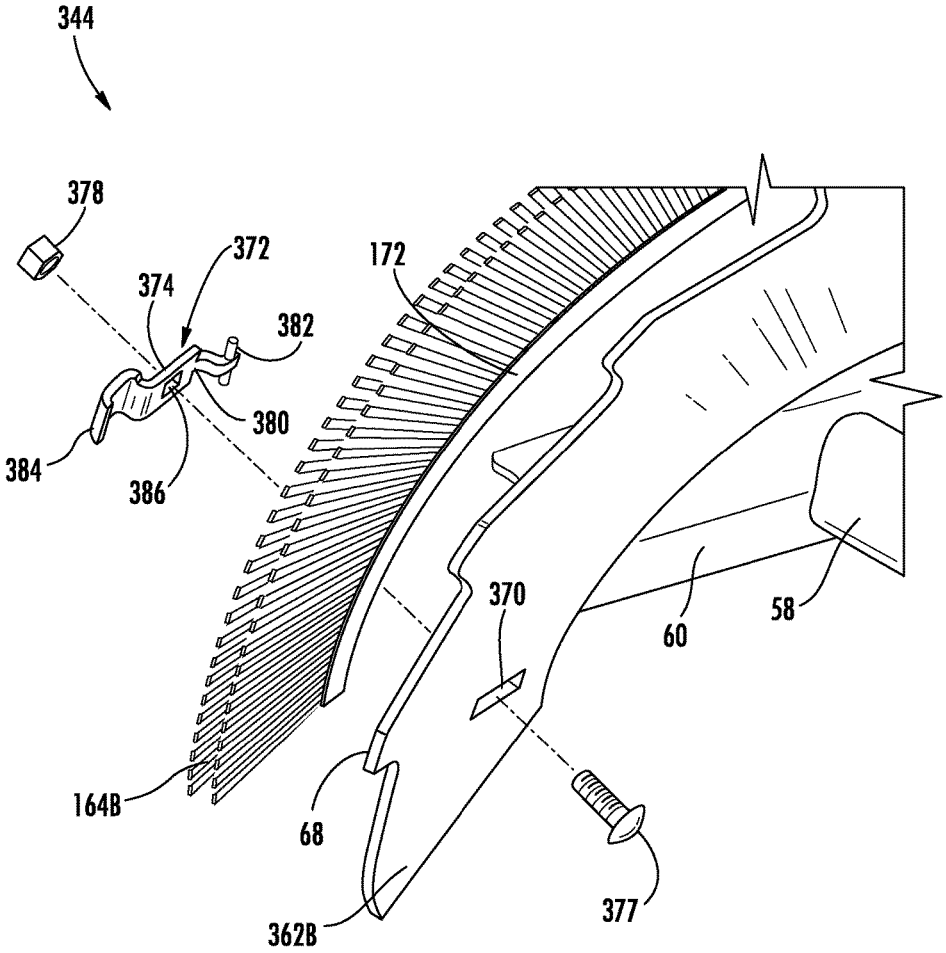
FIG. 12 is an exploded view of the auger flight assembly of FIG. 9.

In the example illustrated, auger flight blades 362 are each configured to be releasably or detachably connected to end portions of pliable flights 164. As shown by FIG. 12, each of auger flight blades 362 comprises a slotted opening 370. As will be described hereafter, slotted openings 370 facilitates adjustable positioning of pliable flights 364 in a radial direction relative to axis 56. In other implementations, each of auger flight blades 362 may alternatively comprise openings 370 which facilitate retention of each of pliable flight blades 362 in a single predetermined or predefined radial position for the particular flight 362.

Pliable flights 164 are described above with respect to auger flight assembly 144. In other implementations, pliable flights 164 may alternatively configured similar to pliable flights 64 described above with regard to auger flight assembly 44. Pliable flights 164 are directly connected to and directly supported by auger flight blades 362 such that the end portions of pliable flights 164 project outwardly radially beyond the outer edges are tips of auger flight blades 362, beyond teeth 68. In the example illustrated, the brushes forming flights 164 radially extend at least ½ inch and nominally at least 1 inch radially beyond the outermost portions of auger flight blades 362, the edges of teeth 68. The brushes forming flights 164 further extend beyond a lowermost edge of auger housing 34. As a result, the brushes forming flights 164 resiliently flex into depressions, recesses or other surface irregularities below auger housing 34 where snow may compact and collect and where such snow may not be reachable by the lower scraping edge of auger housing 34 or blades 162.

In one implementation, pliable flights 164 are adjustably mounted to auger flights 364 to facilitate adjustment of the extent by which flights 164 radially project beyond outer end portions of auger flight blades 362. The brush flights 164A, 164B, 164C, 164D could potentially be adjusted so as to not extend past the outside diameter of auger flight blades 362, or pliable flights 164 may be adjusted to extend well beyond ⅝" (e.g., 1" or more). The radial distance that brush pliable flights 164 extend may be adjusted directly on the auger flight blades 362 themselves to determine the amount of contact each brush has with the surface to be cleared. Alternatively, the height of skid shoes 57 could be adjusted to alter the amount of contact of each pliable flight or brush to the surface.

As shown in FIG. 12, in the example illustrated, such adjustment is facilitated by slotted openings 370 (described above) and clamping system 372. Clamping system 372 comprises clamp 374 and fastener 376 (comprising a bolt 377 and a nut 378 in the illustrated example). Clamp 374 comprises a bracket, clip or flange configured to cooperate with auger flight blade 362 so as to releasably sandwich and capture backing 172 between clamp 374 and a side of blade 362. Claim 374 comprises body 380, hook 382 and backing catch 384.

Body 380 comprises that portion of claim 374 configured to be pressed against or about against a side surface of blade 362 by fastener 376. Body 380 comprises an aperture 386 for being aligned with a selected portion of slotted opening 370. Aperture 36 receives bolt 377 of fastener 376, wherein bolt 377 passes through slotted opening 370 and is retained by nut 378 on an opposite side of body 380.

Hook 382 comprises a tab from a first end portion of body 380. Hook 382 is configured to pass through slotted aperture 377 from a first side of blade 362 and abut or contact a second opposite side of blade 362. Movement of hook 32 within slot adapter 377 adjusts a radial extent that pliable flight 164 projects, if any, beyond outermost edge portions of blade 362.

Backing catch 384 extends from a second opposite end portion of body 380. Backing catch 384 is configured to contact and run along a side of backing 172, pressing backing 172 against a side of blade 362. As a result, backing 172 is captured between catch 384 and the first side of blade 362 so as to be held in place.

Figure 13:
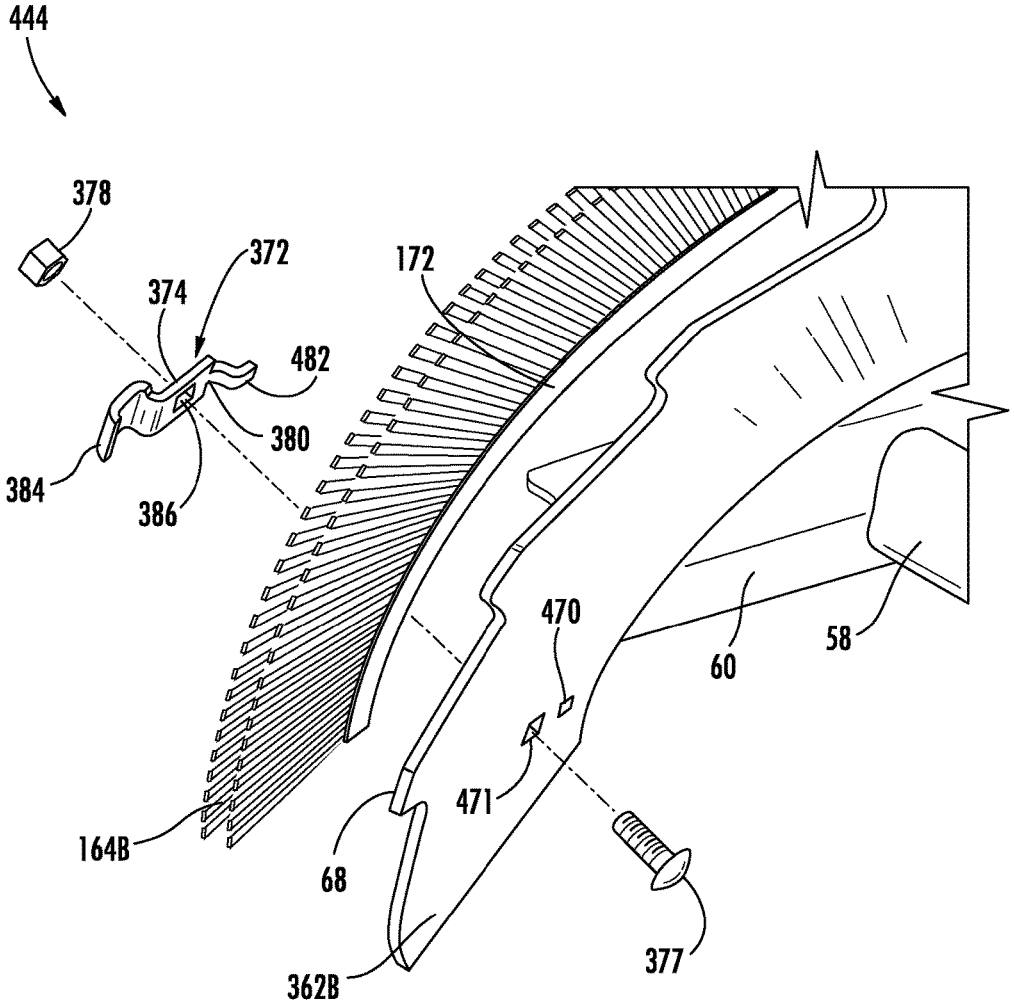
FIG. 13 is an exploded view of another example implementation of the auger flight assembly of FIG. 12.

In other implementations, clamping system 372 may have other configurations or may alternatively be configured to retain pliable flight 164 (or other pliable flights such as pliable flights 64, 264) in a predefined or predetermined position. For example, FIG. 13 is an exploded perspective view illustrating a portion of auger flight assembly 444, another implementation of auger flight assembly 344. Auger flight assembly 444 is similar to auger flight assembly 344 except that auger flight blade 362 comprise apertures 470, 471 in place of slotted aperture 370 and clamp 374 of clamping system 372 comprises hook 482 in place of hook 382. Those remaining components of auger flight assembly 444 which correspond to components of auger flight assembly 344 are numbered similarly. When assembled, hook 482 passes through aperture 470 while bolt 377 of fastener 376 passes through aperture 371 and through aperture 386 into engagement with nut 378 to secure clamp 374 and pliable flight 164 in a predefined radial position alongside auger flight blade 362.

In yet other implementations, clamping system 372 may be omitted where the pliable flight 64, 164, 264 is fixedly secured to blade 362 by welding, bonding or similar attachment structures. The brush flights described herein may be affixed to the auger flights at the time the snow thrower is assembled by the manufacturer. Alternatively, the brush flights may also be purchased by the snow thrower owner as an add-on accessory to a conventional auger configuration. If the brush flights are removable, the brush flights may also be replaced or serviced by the owner or another qualified party.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A snow thrower comprising:

an auger housing; and an auger flight assembly within the housing, the auger flight assembly comprising:

consecutive helical auger flight blades comprising:

a first helical auger flight blade helically extending about a rotational axis;

a second helical auger flight blade helically extending about the rotational axis; and a helical pliable flight helically extending about the rotational axis between the first helical auger flight blade and the second helical auger flight blade, the helical pliable flight having an outer helical extremity radially beyond the first helical auger flight blade and the second helical auger flight blade, wherein the first helical auger flight blade and the second helical auger flight blade spiral 180° out of phase with respect to one another, the snow thrower further comprising:

a second helical pliable flight helically extending about the rotational axis, wherein the helical pliable flight and the second helical pliable flight spiral 180° out of phase with respect to one another, wherein the helical pliable flight and the first helical auger flight blade spiral in phase with one another and wherein the second helical pliable flight and the second helical auger flight blade spiral in phase with one another.

2. The snow thrower of claim 1, wherein the helical pliable flight comprises multiple rows of bristles helically extending in parallel about the rotational axis.

3. The snow thrower of claim 2, wherein the multiple rows diverge outwardly away from one another such that the helical pliable flight has a V-shape.

4. The snow thrower of claim 1, wherein the first helical auger flight blade and the second helical auger flight blade have outer extremities within the auger housing and wherein the outer helical extremity is beyond the auger housing.

5. The snow thrower of claim 1, wherein the outer helical extremity extends at least ½ inch beyond the first helical auger flight blade and the second helical auger flight blade.

6. The snow thrower of claim 1, wherein the first helical auger flight blade has a first radial length and wherein the helical pliable flight comprises bristles, each of the bristles has a second radial length greater than the first radial length.

7. The snow thrower of claim 1 further comprising:

a hub; and supports, each support having a first end coupled to the hub and second ends supporting and spacing an inner helical edge of each of the first helical auger flight blade, the second helical auger flight blade and the helical pliable flight from the hub.

8. The snow thrower of claim 1, wherein the helical pliable flight comprises flexible belting.

9. The snow thrower of claim 1, wherein the helical pliable flight comprises a spiral backing holding first and second rows of bristles in place, wherein each of the first and second rows of bristles begin diverging at the backing.

* * * * *